US005394912A

United States Patent [19]

Hume

[11] Patent Number: 5,394,912

[45] Date of Patent: Mar. 7, 1995

[54] WOOD FIBRE DEBRIS PROCESSOR

[75] Inventor: Alister C. Hume, Surrey, Canada

[73] Assignee: Real Search Inc., Peace River, Canada

[21] Appl. No.: 101,753

[22] Filed: Aug. 4, 1993

[51] Int. Cl.[6] ..... B27L 1/00

[52] U.S. Cl. ..... 144/208 R; 144/162 R; 144/2.7; 144/208 B; 144/341; 144/218; 241/236

[58] Field of Search ..... 144/2 Z, 162 R, 208 R, 144/208 B, 208 F, 218, 340, 341; 241/235, 236

[56] References Cited

U.S. PATENT DOCUMENTS

| | | | |
|---|---|---|---|
| 1,966,153 | 7/1934 | Thorne | 144/208 B |
| 2,894,697 | 7/1959 | Panning et al. | 241/236 |
| 3,385,331 | 5/1968 | Bronemo et al. | 144/2 Z |
| 3,624,756 | 11/1971 | Mellgren | 144/2 Z |
| 3,656,697 | 4/1972 | Nelson | 241/236 |
| 3,690,352 | 9/1972 | Herolf | 144/2 Z |
| 3,866,639 | 2/1975 | Kantola et al. | 144/208 B |
| 4,295,507 | 10/1981 | Karlsson | 144/208 B |
| 4,351,485 | 9/1982 | Hardwick et al. | 241/236 |
| 4,574,854 | 3/1986 | Lindblom et al. | 144/2 Z |
| 4,665,961 | 5/1987 | Forslund | 144/2 Z |
| 4,685,498 | 8/1987 | Nakajima et al. | 144/208 B |
| 4,691,750 | 9/1987 | Nakajima | 144/208 B |
| 5,094,281 | 3/1992 | Barnhill et al. | 144/208 J |

FOREIGN PATENT DOCUMENTS

| | | | |
|---|---|---|---|
| 94804 | 11/1962 | Denmark | 144/208 J |
| 383443 | 4/1963 | Japan | 144/208 J |

OTHER PUBLICATIONS

CAE Fuji King Debarker, CAE Machinery Ltd., Vancouver, B.C., Canada.

*Primary Examiner*—W. Donald Bray
*Attorney, Agent, or Firm*—Oyen Wiggs

[57] ABSTRACT

This invention pertains to a novel wood fibre debris processor. More particularly, this invention relates to an apparatus which can simultaneously segregate or classify and debark in a singular process wood fibre debris which results from storage and handling of logs for primary forest resource manufacturing industries. A wood fibre debris processor comprising: (a) an enclosed frame; (b) at least one rotatable first type abrader roll disposed laterally across an interior of the frame; (c) at least one rotatable second type abrader roll disposed laterally and adjacent to the first type abrader roll across the interior of the frame; (d) at least one first wood fibre debris abrader means disposed on the first type abrader roll; and (e) at least one second wood fibre debris abrader means disposed on the second type abrader type roll.

18 Claims, 8 Drawing Sheets

WOOD FIBRE DEBRIS PROCESSOR

FIELD OF THE INVENTION

This invention pertains to a novel wood fibre debris processor. More particularly, this invention relates to an apparatus which can simultaneously segregate or classify and debark in a singular process wood fibre debris which results from storage and handling of logs for primary forest resource manufacturing industries.

BACKGROUND OF THE INVENTION

Wood fibre debris which develops as a result of storage and handling of logs for use in the primary forest resources manufacturing industries has generally been collected and disposed of in landfill sites, usually adjacent to the primary mills. In the case of sawmills, the traditional means of disposing of the accumulated debris has been by burning it in tee-pee or silo burners. Millions of cubic meters of wood fibre has been disposed of by this means in the last few decades. This is both a pollution source and a waste.

Increased environmental sensitivity to both landfilling and burning is bringing about a change in the forest resources industry. Tighter controls, and the legislated elimination of open burning, have resulted in the industry looking at alternative means for disposal and/or other end uses for this wood fibre debris. One of the logical and obvious alternatives to either burning (tee-pee or silo, non heat recovery) or landfilling is to convert the wood fibre rich debris into a homogeneous hog fuel to fire power boilers. The major problem with this approach is the lack of a market for the hog fuel in areas other than those in close proximity to existing major users. Although there is now significant movement toward the use of this surplus residual debris for fuel to fire cogeneration facilities, this end use is very limited to date and makes up a very small fraction of the gross volume of wood fibre debris available.

With the shrinking virgin fibre basket, it is evident that much more must be done to direct the maximum amount of total fibre harvested into the most appropriate and highest value end uses. It would be a valuable development if more of the normally wasted or misused residual wood fibre debris, which is rich in wood fibre, could be converted to usable pulp chips, as the highest end-value product. To date, no single piece of equipment has been available to economically, efficiently and simultaneously segregate or classify raw wood fibre debris, and effectively remove the bark from the broken log chunks, in preparation for chipping.

In order to process raw wood debris in the field today, using currently available equipment, it would be necessary to first feed the debris from a live bottom hopper to a set of scalping screens to separate different size fractions and then to a debarker such as an apparatus sold by CAE Machinery Ltd. under the trade-mark Fuji King. Large rocks are normally separated from the debris by using gap rolls.

SUMMARY OF THE INVENTION

We have invented a primary wood fibre debris processor which accepts raw wood fibre debris from log-yards, or from previously landfilled areas, separates the smaller debris and debarks the remaining fraction. The size of the fractions is determined by the disc spacing, the spacing between shaft and the diameter and shape of the abrader bars on the disc shafts of the processor.

The invention is directed to a wood fibre debris processor comprising: (a) an enclosed frame; (b) at least one rotatable first type abrader shaft disposed laterally across an interior of the frame; (c) at least one rotatable second type abrader shaft disposed laterally and adjacent to the first type abrader shaft across the interior of the frame; (d) at least one first type of wood fibre debris abrader means disposed on the first type abrader shaft; and (e) at least one second type of wood fibre debris abrader disposed on the second type abrader shaft.

The first type and second type abrader shafts of the processor can be shafts which have spacedly disposed thereon respectively, a plurality of abrader mounting means, said mounting means having the respective first and second wood fibre debris abraders mounted thereon. The mounting means can be a plurality of discs and the discs on the first type abrader shaft can be offset relative to the positions of the plurality of discs on the second type abrader shaft. The second type abrader shaft can be rotationally disposed in the processor at an elevation higher than the first type abrader shaft.

The processor can have three or more rotational abrader rolls extending laterally across the interior of the frame, the first type abrader shafts alternating with second type abrader shafts, each successive abrader roll being mounted at an elevation higher than the elevation of the preceding abrader shaft. The plurality of discs can have primary abrader bars spatially secured to the circumference thereof, and secondary abrader bars spatially secured to the circumference of the disc between the primary abrader bars.

Plates or finger bars can be mounted on interior walls of the frame adjacent the rolls to prevent passage of wood fibre debris around the ends and sides of the first and second type abrader shafts. A debris collecting chute can be positioned below the four first and second type abrader shafts. The processor can include a wood fibre debris inlet above the first and second type abrader shafts.

The first and second type abrader shafts can rotate in bearings secured to respective walls of the frame. The first type abrader shaft can have a plurality of radially disposed circular discs spatially mounted thereon, the primary abrader bars being arranged thereon around the circumference of the disc at 90° positions relative to one another.

The processor can include an adjustable debris discharge gate located away from the debris inlet.

The primary abrader bars can be disposed 45° relative to the radius of the circular discs, and two or more secondary abrader bars can be secured to the circumference of each of the discs for every single primary abrader bar.

The frame can have a rock disposal gate built into the bottom region of the frame to remove large rocks which cannot pass through the spaces between the discs. The discs can have debris clearing means on the faces of the discs and the abrader bars can be removable.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
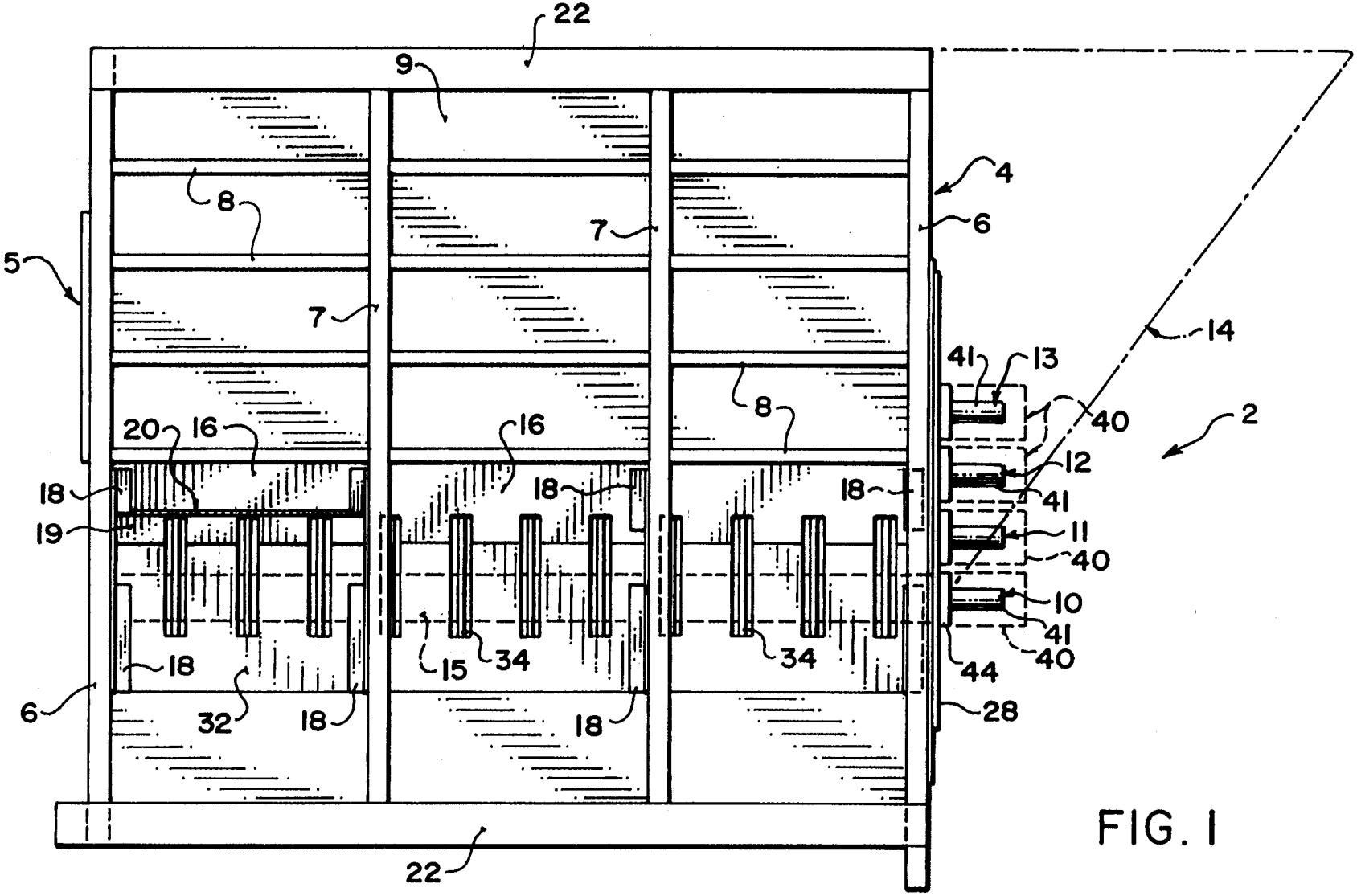
FIG. 1 illustrates an elevation view of the wood fibre debris processor.

Referring to the drawings, FIG. 1 illustrates an elevation view of the wood fibre debris processor 2. The wood fibre debris processor 2 has a box-like frame 4 which is constructed of eight vertical reinforcing steel structural tubes, 7 (four of which are visible in FIG. 1) and eight horizontal reinforcing steel angle bars 8 (four of which are visible in FIG. 1). The top and bottom, front and rear corners of the frame 4 are reinforced with main horizontal reinforcing bars 22, which are typically box-steel beams. As seen in FIG. 1, four alternating steel shafts 10, 11, 12, and 13 extend horizontally and laterally through the midsection of the frame 4. These alternating steel shafts 10, 12, 10 and 12 are two types which will be discussed in detail below. A guillotine-type discharge gate 5, which can be raised or lowered to control the level of material in the processor 2 (the left end as seen in FIG. 1) and to regulate the amount of material that is discharged from the processor 2. FIG. 1 also illustrates upper and lower mounting brackets 18 which support a front finger plate 16 and a bottom plate 32 (see FIGS. 2 and 3 for further details). FIG. 1 further illustrates in dotted lines a raw wood fibre debris infeed chute 14, which has a sloping curved bottom configuration which enables raw wood fibre debris to be fed smoothly into the processor for processing. While the processor 2 is shown as horizontal in FIG. 1, it may be tilted to one side, for example, to the left as seen in FIG. 1, in order to provide some right to left motion to the flow of wood debris in the processor 2. Such tilting is discretionary, according to the application and results obtained in specific applications.

Figure 2:
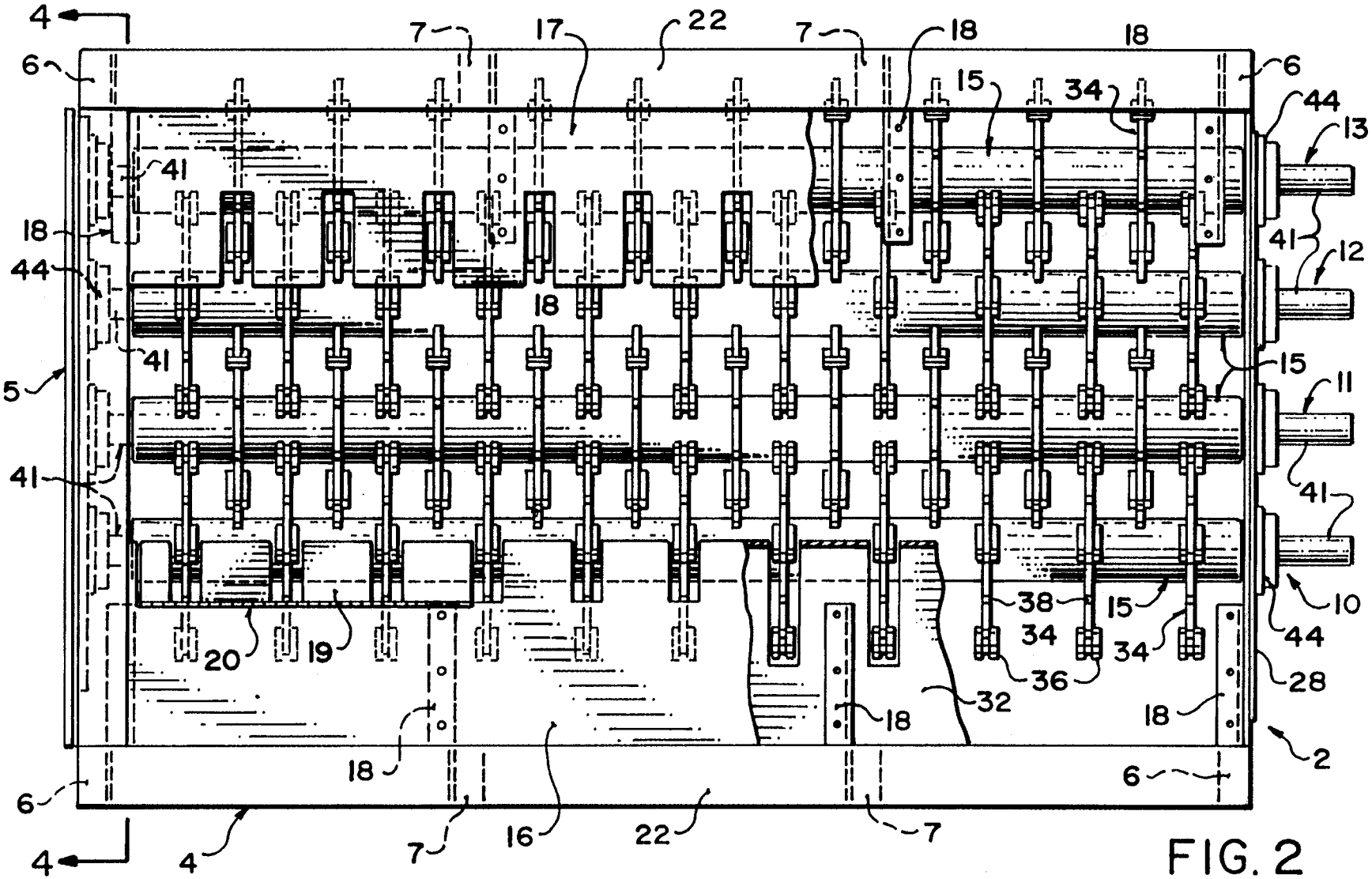
FIG. 2 illustrates a plan view of the wood fibre debris processor.

FIG. 2 illustrates a plan view of the wood fibre debris processor 2. FIG. 2 illustrates in detail the manner in which steel abrader shaft type A 10, 12 and abrader shafts type B 11, 13 are arranged parallel and extend laterally across the interior midsection of the wood fibre debris processor 2. The shafts 10, 11, 12 and 13 are supported in bearings at each end and can be rotated. Abrader shafts 10, 11, 12 and 13 are arranged at an angle upwardly toward the gate 5 rear of the wood fibre debris processor 2. Each abrader shaft 10, 11, 12 and 13 radially, and parallel to one another, carries a series of steel discs 34. These discs 34 are staggered relative to one another to provide a strong wood fibre debris processing action, as will be explained in more detail below, when the alternating shafts 10, 11, 12 and 13 are rotated. Abrader shafts type A 1912 have eleven discs 34 spaced equally across the length of the abrader shafts type A 10, 12. Abrader shafts type B 11, 13 on the other hand, have ten discs 34 equally spaced along their length. The discs 34 on abrader shafts type B 11, 13 are spaced so that they extend into and fit equidistantly between the spaces of the discs 34 of abrader shafts type A 10, 12. FIG. 2. also illustrates front finger plate 16 and rear finger plate 17, in partial detail. These finger plates 16 and 17 prevent wood fibre debris from falling beyond the ends of abrader shafts type A 10, 12 to the front, and abrader shafts type B 11, 13 to the rear, thereby escaping the active churning action of the four abrader shafts 10, 11, 12 and 13. These finger plates 16 and 17 are mounted on respective brackets 18. FIG. 2 illustrates a rock discharge gate 19 which, as explained below, is used to discharge oversized rocks from the interior of the wood fibre debris processor 2.

Figure 3:
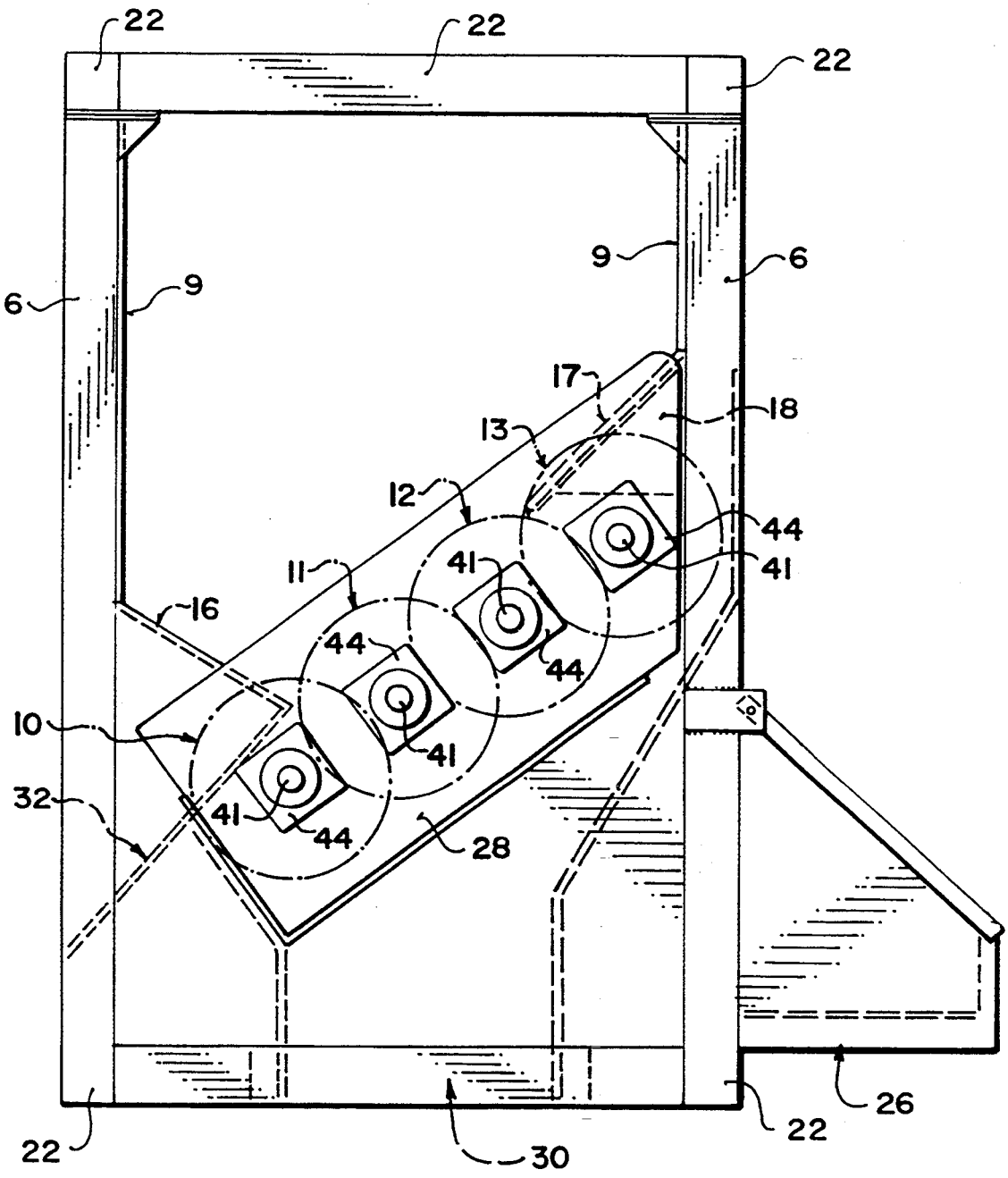
FIG. 3 illustrates a right elevation view of the wood fibre debris processor.

FIG. 3 illustrates a right elevation view of the wood fibre debris processor 2. The angled rearwardly ascending orientation of the four abrader shafts 10, 11, 12 and 13 is clearly shown in FIG. 3. Front finger plate 16 is positioned at a rearwardly sloping angle at the front of the processor 2 above shaft 10 while rear finger plate 17 is positioned at a frontwardly sloping angle at the rear above shaft 13. The end 19 of the plate 16 proximate shaft 10 is constructed so that it can be swung open or withdrawn in order to provide an opening to enable rocks and boulders to be cleared from the processor 2. The rocks drop onto angled bottom plate 32 and are removed from the processor 2. FIG. 3 also illustrates a bearing support 28 on which the bearings for shafts 10, 11, 12 and 13 are mounted and upon which support 28 is readily mounted to the side wall of the processor 2. FIG. 3 also illustrates a drive base 26, upon which a hydraulically driven power source 40 can be mounted for the purpose of rotating the abrader shafts 10, 11, 12 and 13 at prescribed speeds, generally in the order of 25 to 50 rpm. As a general rule, to provide a good active churning action, the abrader rolls are driven at increasing rates of rotation from the front to the rear of the wood fibre debris processor 2. In other words, second in line abrader shaft 11 is driven at a faster rate of rotation than abrader shaft 10. Likewise, abrader shaft 10 is driven at a faster rpm than abrader shaft 11. Similarly, the uppermost rear abrader shaft 13 is driven at the fastest rpm of the four abrader rolls. Each higher roll is normally driven about 10–15 percent faster than the adjacent lower roll. This action provides an active non-pinching tumbling action on the wood fibre debris that is fed into the wood fibre debris processor 2 above the four abrader shafts 10, 11, 12 and 13 via infeed chute 14. The speed of rotation and relative rotation of the shafts 10, 11, 12 and 13 can be varied as required to provide the optimum wood debris processing action. This is determined by experimentation with the particular wood debris being processed. The wood fibre debris is normally fed into the space above the four abrader rolls from the right side of the wood fibre debris processor 2, as shown in dotted lines in FIG. 1. As the wood fibre debris is processed by the rotating abrader shafts 10, 11, 12 and 13, and the discs 34 and primary and secondary abrader bars 36 and 38, as will be explained below, the wood fibre debris is sorted, debarked, degravelled and destoned, and sifts downwardly between the spaces between the adjacent abrader shafts 10, 11, 12 and 13. This sifting action provides a processed wood fibre debris product, which is rich in wood fibre and is virtually free of useless debris, such as gravel, bark and stones, as will be explained below. FIG. 3 also illustrates the collecting chute 30 which collects the sorted and sifted debris after it has passed downwardly through the spaces between shafts 10, 11, 12 and 13. Plate 32 discharges large rocks clear of the processor frame 2 when rock discharge gate 19 is opened.

Figure 4:
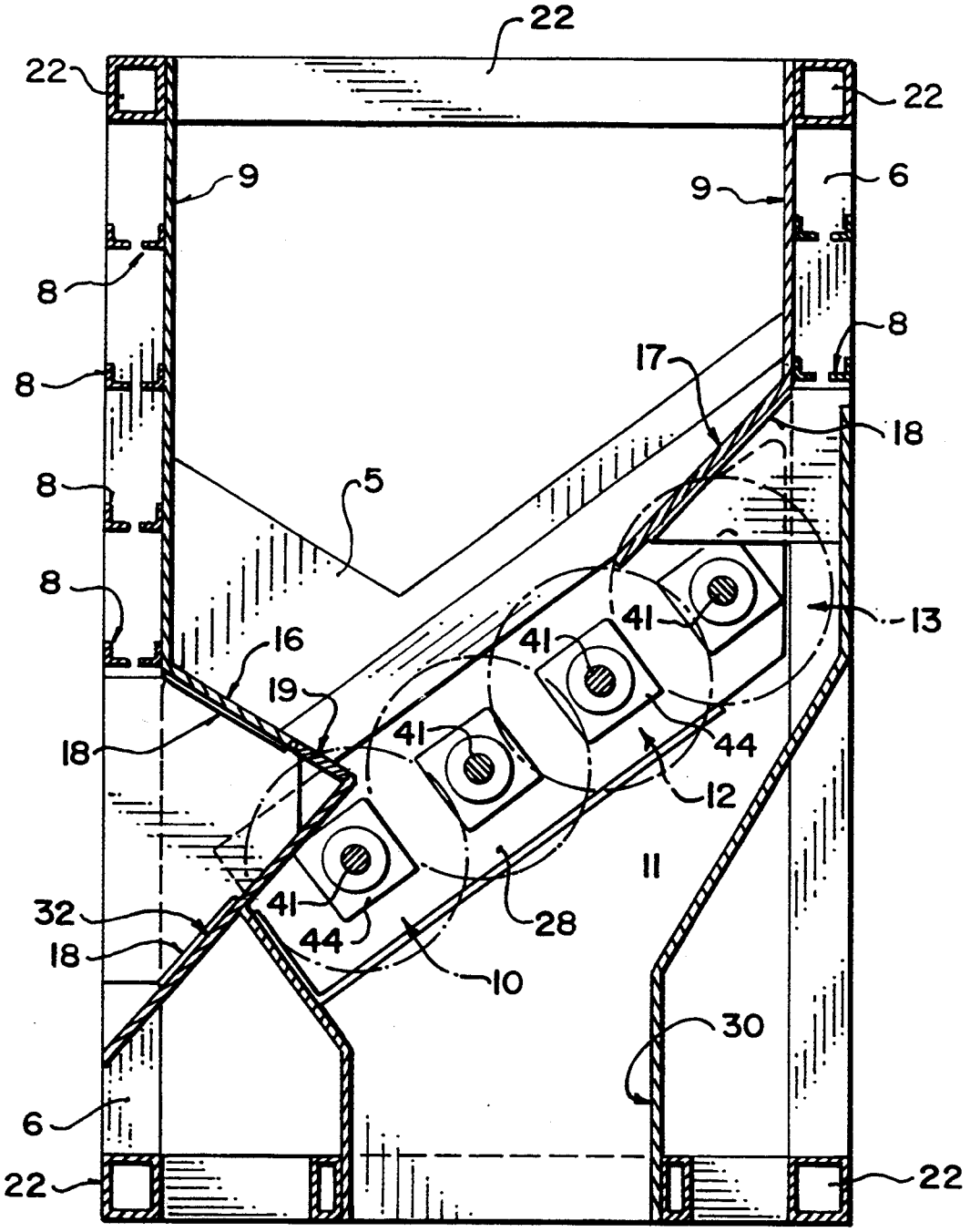
FIG. 4 illustrates a right section view of the wood fibre debris processor taken along section line A-A of FIG. 2.

FIG. 4 illustrates a right elevation view taken along section line 4-4 of FIG. 2. In this view, the angled front finger plate 16, the bottom plate 32 and the rear finger plate 17 can be clearly seen. Square bearing plates 44, which rotationally secure the four abrader shafts 10, 11, 12 and 13 to the bearing support plate 28 which is mounted to ends of the frame 4 are constructed so that the abrader shafts 10, 11, 12 and 13 can rotate readily relative to the stationary frame 4.

Figure 5:
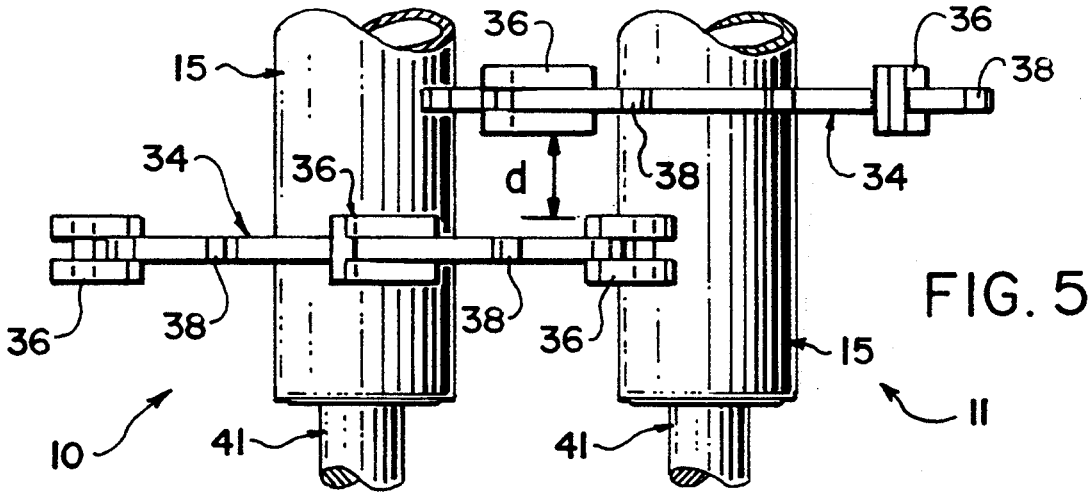
FIG. 5 illustrates a plan detail of a segment of an abrader shaft type A and an abrader shaft type B of the wood fibre debris processor.

FIG. 5 illustrates a plan detail enlarged view of the respective discs 34 on adjacent abrader shafts 10, 11. The distance (denoted by "d" in FIG. 5) between the adjacent discs 34 determines the "opening" between the discs and hence the size of the debris that is passed downwardly through the processor 2 after processing. Usually, the "opening" d will be about 3-½ inches.

Figure 6:
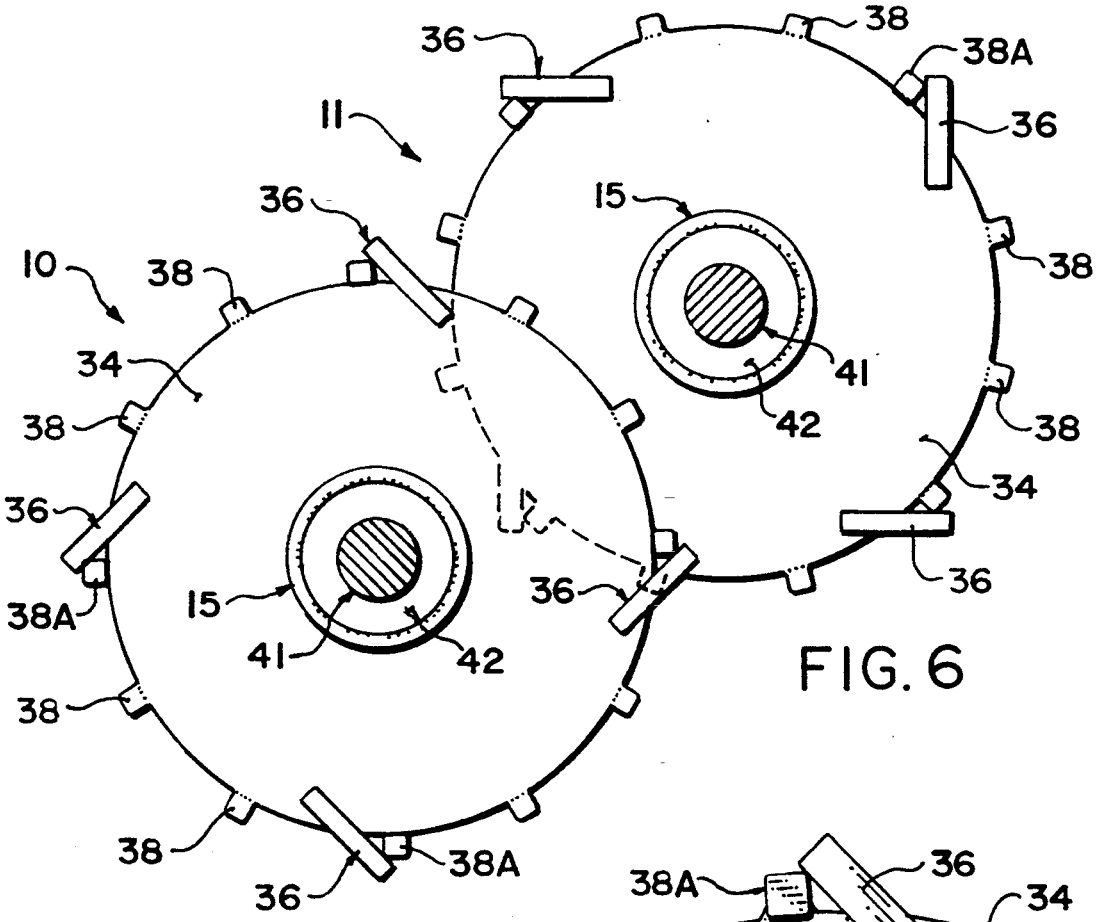
FIG. 6 illustrates a detailed end view of an abrader shaft type A and an abrader shaft type B of the wood fibre debris processor.

The disc 34 on abrader shaft 10 which can be welded or bolted in place according to conventional methods, has mounted thereon four primary abrader bars 36, and eight secondary abrader bars 38, all of which are typically formed of steel key stock. The number of bars 36 and 38 may be varied as required. Disc 34 of adjacent abrader shaft has a similar number of primary abrader bars 36 and secondary abrader bars 38, except that they are initially arranged 45° out of synchronization with the primary and secondary abrader bars 36 and 38 of abrader shaft 10. This positioning is more clearly illustrated in FIG. 6, which clearly shows discs 34 of the two shafts 10, 11 with the primary abrader bars 36 of roll 10 arranged at 12, 3, 6 and 9 o'clock positions, while the primary abrader bars 36 of adjacent abrader shaft 11 are arranged at 1:30, 4:30, 7:30 and 10:30 o'clock positions. The same alternating staggered positioning is applicable to abrader shaft 12 and abrader shaft 13, making up the four, shafts 10, 11, 12 and 13 as seen specifically in FIG. 2. When the processor 2 is in operation, this positioning does not remain constant, however, because shafts 10, 11, 12 and 13 rotate at slightly faster speeds relative to one another. However, this constantly shifting relationship provides an active non-pinching continuously varying wood fibre impacting action on the debris that is being tumble processed above the abrader shafts 10, 11, 12 and 13.

Figure 7:
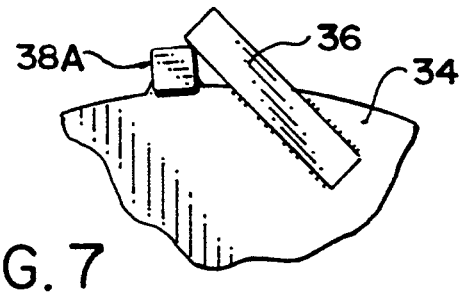
FIG. 7 illustrates an enlarged detail of the primary abrader bar of the abrader shaft of the wood fibre debris processor.

FIG. 7 illustrates a detailed side view of the construction of one of the primary abrader bars 36 and one of the secondary abrader bars 38. The primary abrader bars 36 are typically formed of square steel key stock, and arranged at a 45° angle relative to the radius of the disc 34. Each primary abrader bar 36 comprises a pair of bars formed of such key stock, one positioned on each side of the circumferential edge of the disc 34. The top ends of the pair of abrader bars 36 are welded to a single key stock 38A, which is also welded to the periphery of the disc 34. The angle of the primary abrader bars 36, and the number of same, and the number of secondary abrader bars 38, can be varied as required in order to process specific compositions of wood fibre debris, according to engineering principles known by a person skilled in the art of wood processing. It will be understood that the abrader bars 36 and secondary abrader bars 28 can be constructed differently for commercial purposes. For instance, rather than being welded on, they can be bolted to disc 34 for ready removal when worn out. The bars can also be of different configuration, for example, curved, or sharp, to provide different action to the debris processing function. A certain degree of testing and trial and error may be required in each case, but such trial and error is considered to be within the scope of this invention. The grinding, tumbling, sorting and debarking action of the revolving primary abrader bars 36 and secondary abrader bars 38 are discussed in more detail below.

Figure 8:
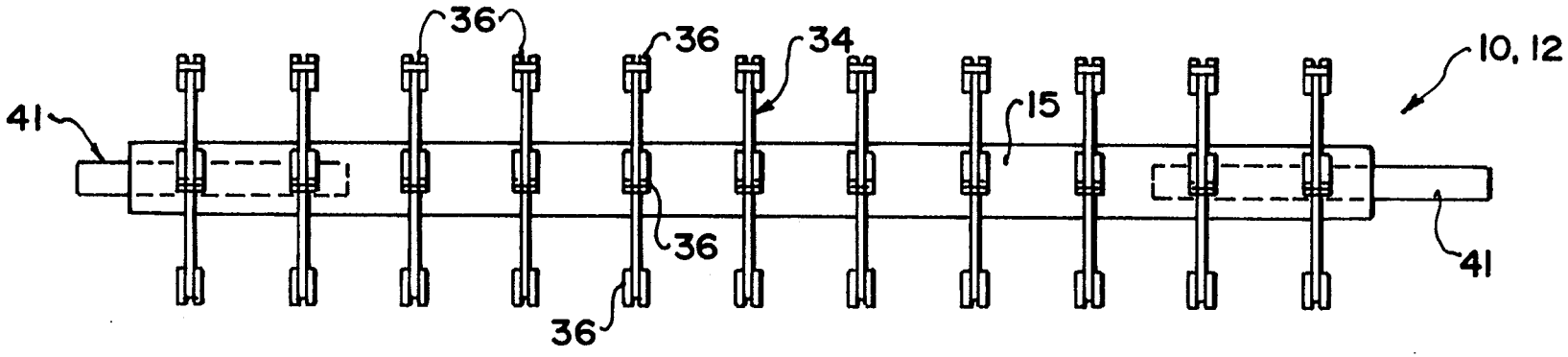
FIG. 8 illustrates a detailed plan view of an abrader shaft type A or abrader shaft type C of the wood fibre debris processor.

FIG. 8 illustrates a top detail view of an abrader shaft type A 10, 12. The shaft 10 penetrates through the interior of the circumferentially arranged pipe 15, upon which the discs 34 are spatially and parallel distributed. The cylindrical shaft 10 is journalled for rotation in bearing mounting plates 44. As is shown in FIG. 8, eleven circular discs are equidistantly disposed along the length of pipe 15. The primary abrader bars 36 are positioned in alignment at 90° locations around the circumferences of the respective discs 34. It will be understood that the number of discs 34 and number of abrader bars 36, 38 can be varied as required to provide the required debris processing action.

Figure 9:
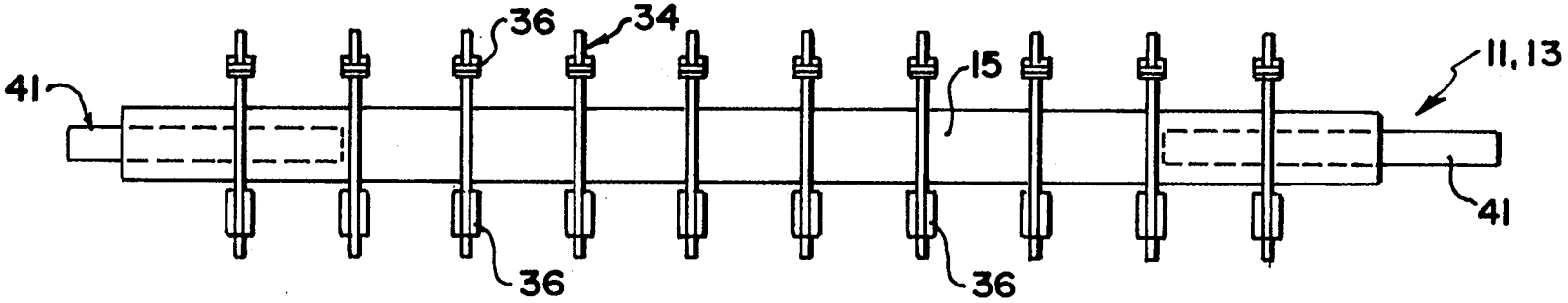
FIG. 9 illustrates a detailed plan view of an abrader shaft type B of the wood fibre debris processor.

FIG. 9 illustrates a top plan view of an abrader shaft type B 11, B 13. The construction is similar to the abrader shaft type A 10, 12 as illustrated in FIG. 8. A cylindrical steel shaft 41 extends through the interior of pipe 11. Ten circular discs 34 are equidistantly disposed and secured along the length of pipe 15. The spacing is set so that the discs 34 of abrader shaft type B 11, 13 are offset equidistantly from the opposing and facing discs 34 of adjacent abrader shafts type A 10, 12. Again, the number of discs 34 on shafts type B 11, 13 and the number of bars 36, 38 can be varied. The spacing between the respective discs 34, and the spacing between adjacent pipes 15, is determined according to the nature of the wood fibre debris that is to be processed by the processor 2. As a general rule, for typical logyard debris applications, the nominal spacing "d" should be 3-½ inches between adjacent primary abrader bars 36. The spacing between the adjacent and offset matching discs 34 is somewhat greater. The spacing between the shafts 10, 11, 12 and 13 is set so that the abrader bars 36 clear the pipes 15 of adjacent shafts by about one inch. It will be understood by a person skilled in the art that the relative spacings between discs 34, shafts 10, 11, 12 and 13 and abrader bars 36 can be varied in order to maximize wood debris processing action. The primary abrader bars 36, when rotated relative to one another, on adjacent alternating shafts 10, 11, 12 and 13, at higher relative speeds, one to the other, provide a strong non-pinching, self-cleaning wood fibre debris processing action, which separates the bark and other waste from the wood fibre material, as well as removing the bark from wood chunks, thereby providing and salvaging wood fibre which can be used in a conventional wood processing operation, such as pulp mills or wafer or particle board plants.

Figure 10:
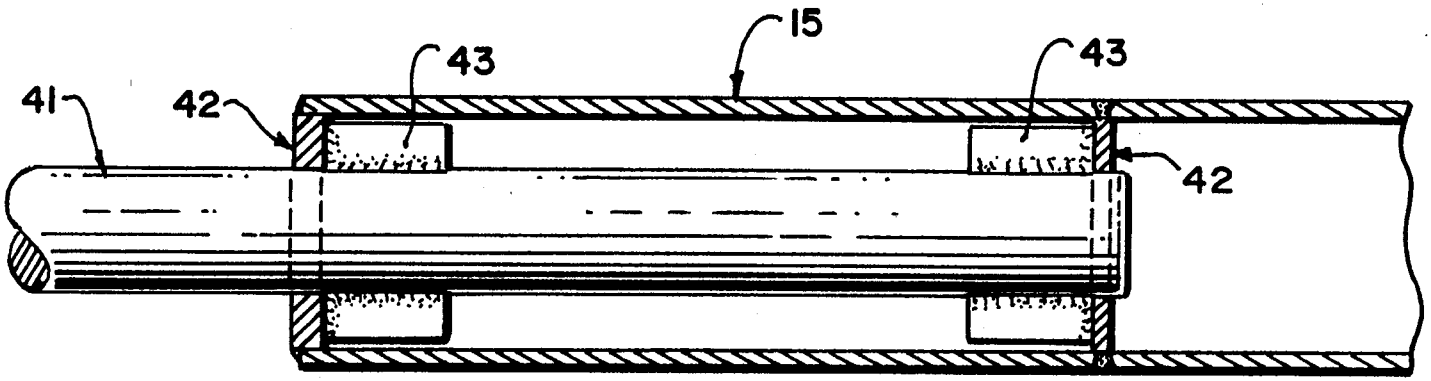
FIG. 10 illustrates a detailed view impartial section of the end of an abrader shaft.

FIG. 10 illustrates a detailed view partially in section of the end construction of a typical abrader shaft 10. Shaft 41 has its axis coincident with the axis of pipe 15, thereby ensuring that pipe 15 and the discs 34 do not have any eccentric action. A circular end plates 42 fit over shaft 41 and hold pipe 15 in position. Positioning blocks 43 also assist in holding pipe 15 in position. These are typically welded in place. Other conventional methods may also be employed to hold the pipe 15 in position.

Figure 11:
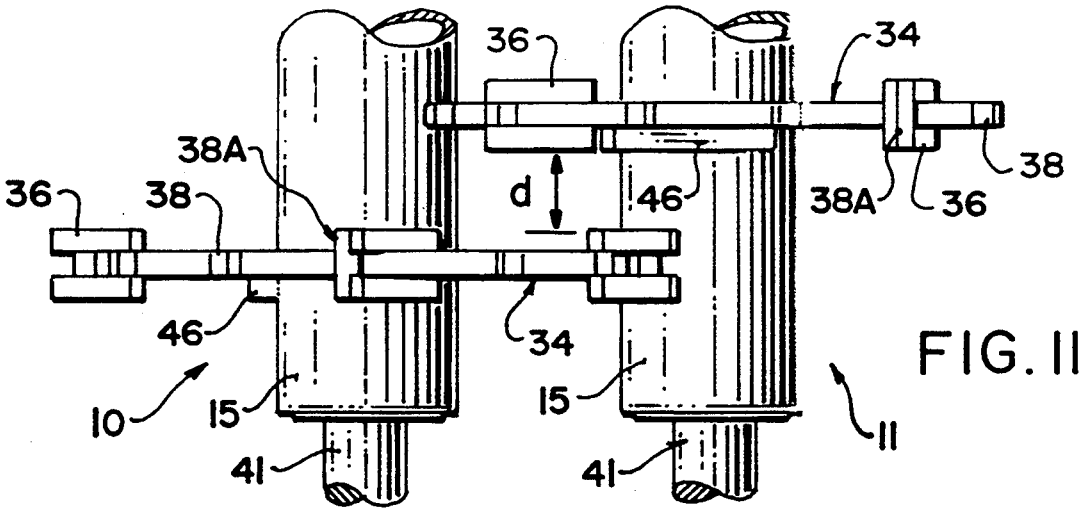
FIG. 11 illustrates a plan detail of a segment of an alternative embodiment of shaft types A and B of the wood fibre debris processor.
Figure 12:
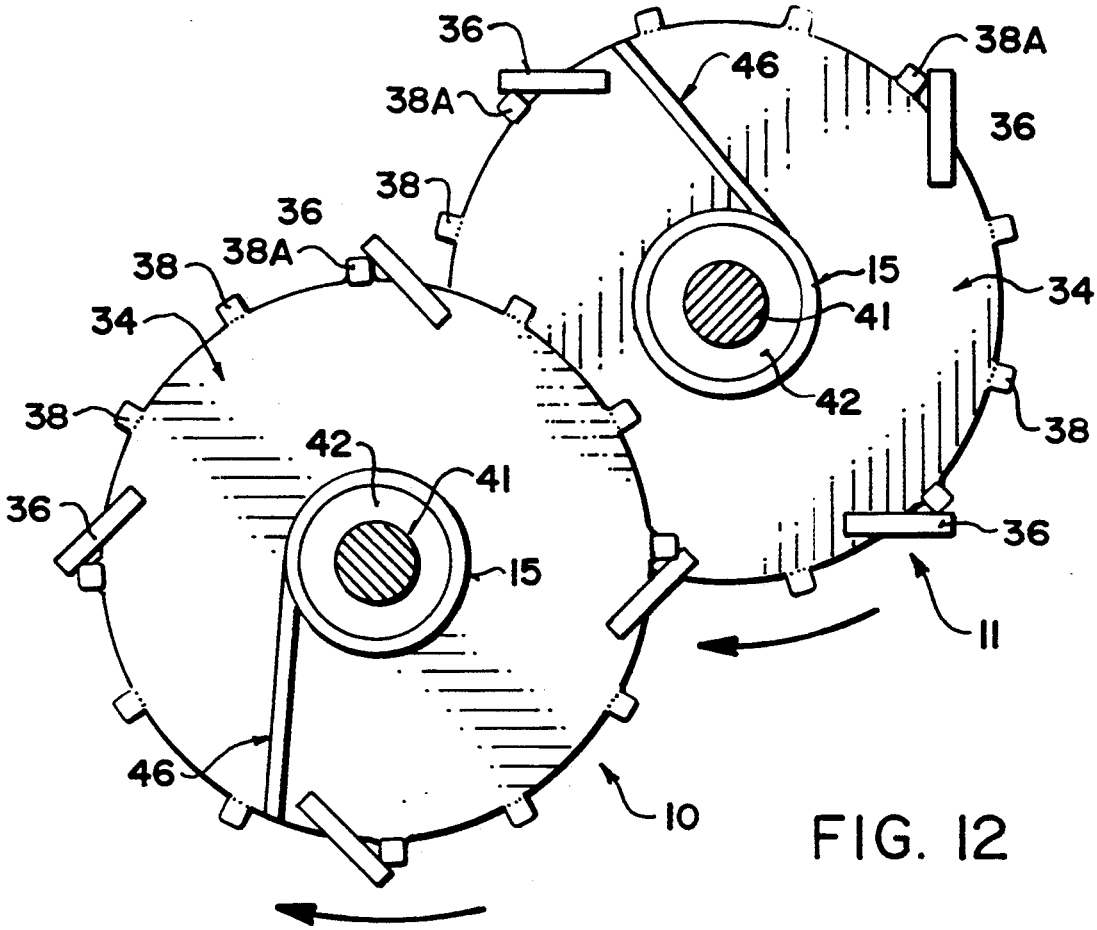
FIG. 12 illustrates a detailed end view of an alternative embodiment of shaft types A and B of the wood fibre debris processor.

FIG. 11 illustrates a plan detail of a segment of an alternative embodiment of shafts type A 10, 12 and B 11, 13 of the wood fibre debris processor 2. FIG. 12 illustrates a detailed end view of the alternative design illustrated in FIG. 11. In both FIGS. 11 and 12, the discs 34 are fitted with self-cleaning bars 46. These bars 46 are optional and can be used to assist in providing a self-cleaning action to the spaces "d" between the adjacent discs 34. As seen in FIG. 12, the bar 46 is installed at an angle to the radius of the disc 34 to provide a radial sweeping action, since the discs 34 rotate clockwise (shown by the arrow in FIG. 2). The bars 46 can be welded or bolted to the disc 34.

DESCRIPTION OF OPERATION OF THE PROCESSOR

The processor 2 is unique in that there is no machine on the market which can perform its function. While a number of functions are combined in the processor 2, in general terms, it can be regarded that the processor 2 combines in one apparatus the action of aggressive wood product scalping rolls, and the tumbling action of a conventional drum debarker. While various sizes are possible, the processor design is typically based on six or nine meter modules. The first module is a combination of an infeed hopper and the primary debarking section.

As explained previously, the main construction of the processor 2 consists of a heavy steel central trough formed by the walls and front and rear finger plates 16 and 17 and three or more parallel large diameter heavy duty shafts 10, 11, 12 and 13 with their axes running parallel to the centerline of the trough. These shafts 10, 11, 12 and 13 are mounted at an angle to the horizontal (in cross-section). The angle of inclination is determined by the type of wood chunks and the wood species to be processed, and will generally be between 25° and 45°.

The heavy pipe abrader shafts 10, 11, 12 and 13 are fitted with thick plate discs 34 which carry primary 36 (replaceable) and secondary abrader bars 38 to generate a "live" non-punching tumbling action within the base of the trough, and to impart sufficient impact on the wood chunks to precipitate initiation of the debarking process. The action also sorts out rocks, boulders, and the like, which are separated and ejected from the processor.

The processor 2 is fitted with a conventional discharge gate 5 at the discharge end. Hydraulic drive(s) 40 of conventional design connected to the shafts 10, 11, 12 and 13 control wood debris dwell time in the processor 2, and determine the debarked quality of the finished product.

Wood fibre debris material is loaded into the first three meter section of the processor 2 with a conventional wheel or track loader making use of the loading chute 14. The processor 2 operator judges the degree of separation of waste product from the raw wood fibre debris by observing the burden of material on a collector belt which can be installed under the processor 2, and the quality of the debarked product that comes out of the end of the processor 2. If the barking is not entirely satisfactory, the operator can adjust the elevation of the discharge gate 5, and hence the discharge opening, to increase or decrease the wood debris dwell time in the processor 2, and/or also adjust the speed of rotation of the abrader shafts 10, 11, 12 and 13 to increase or decrease the severity of tumbling and abrading action on the debris in the processor 2. In this way, the required degree of debarking can be obtained.

A hydraulically actuated dump-gate 19 is provided along the lower edge of the infeed section of the processor 2 to facilitate removal of large rocks which cannot pass between the discs 34. Following discharge from the processor 2 through gate 5, the debarked wood chunks are passed over an aligner-roll conveyor (not shown) to dropout any short chunks, or waste debris that is carried out of the processor 2. This is followed by a high pressure water shower. After the shower, the wood blocks are transported by a belt conveyor (not shown) over a metal detector and ultimately into a gravity feed, bottom discharge drum-type chipper of conventional construction. The wood chips are collected under the chipper in a conventional screw discharge surge hopper (not shown), and are conveyed either into an airlock feeder to be blown into a conventional chip van, or alternatively, passed over a conventional shaker screen to remove the less than ¼" fraction before being blown into the chip van.

The smaller waste debris (generally less than 4" diameter and 12" long) is collected on a standard refuse belt conveyor (not shown) located under the processor 2, and can be either deposited back onto the landfill area, or further processed for full recovery of all the valuable wood fibre components present. This can be accomplished by passing the material over a typical de-stoning conveyor and through conventional screening systems to effect the appropriate classification of materials for the end uses desired. The byproducts generally consist of the fines fraction which usually contain a high percentage of mineral content (gravel, clay, dirt and sand), a wood fibre hog fuel component, and rocks which could be recycled back to the logyard, or crushed for other uses.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A wood fibre debris processor comprising:

(a) an enclosed hollow frame;

(b) at least one rotatable first type abrader shaft disposed laterally across an interior of the frame;

(c) at least one rotatable second type abrader shaft disposed laterally and adjacent to the first type abrader shaft across the interior of the frame, said second type abrader shaft being rotationally disposed at an elevation higher than the first type abrader shaft;

(d) at least two first discs spatially and radially disposed on the first type abrader shaft;

(e) at least two second discs spatially and radially disposed on the second type abrader shaft, the spaced positions of the plurality of discs on the first type abrader shaft being offset relative to the spaced position of the plurality of discs on the second type abrader shaft, a portion of the proximate circumferences of the plurality first discs and the second discs intersecting a common plane between the first discs and the second discs;

(f) at least one respective first wood fibre debris abrader means disposed on the circumference of each of the first discs of the first type abrader shaft; and (g) at least one respective second wood fibre debris abrader means disposed on the circumference of each of the second discs of the second type abrader shaft.

2. A processor as claimed in claim 1 wherein the first and second discs have spacedly disposed on the circumference thereof respectively, a plurality of first and second wood fibre debris abraders.

3. A processor as claimed in claim 2 wherein the first type abrader shaft has at least ten discs spatially and radially disposed thereon equidistant form each other, the second type abrader shaft has at least ten discs spatially and radially disposed thereon equidistant from each other, and alternating in position offset with the plurality of discs on the first type abrader shaft, the spaces between the adjacent alternating offset discs on the first type abrader shaft and the second type abrader shaft forming a plurality of sized openings for passage of sized wood fibre debris.

4. A processor as claimed in claim 3 wherein the second type abrader shaft is rotationally disposed in the processor at an elevation higher than the first type abrader shaft, the second type abrader shaft being rotated at a higher rate of speed than the first type abrader shaft.

5. A processor as claimed in claim 3 wherein the processor has at least three rotational abrader shafts extending laterally and parallel across the interior of the frame, each first type abrader shaft alternating with each second type abrader shaft, the plurality of discs on the first type shaft alternating in offset position with the plurality of discs on the second type shaft, each successive alternating abrader shaft being mounted at an elevation higher than the elevation of the preceding abrader shaft.

6. A processor as claimed in claim 1 wherein the processor has four rotational abrader shafts extending laterally across the interior of the frame, each shaft being parallel and spaced from one another, each first type abrader shaft, and the plurality of discs on the first type shaft alternating in offset position with each second type abrader shaft, and the plurality of discs on the second type shaft, each successive abrader shaft being mounted at an elevation higher than the elevation of the preceding abrader shaft.

7. A processor as claimed in claim 6 wherein the plurality of first and second discs radially and spatially disposed on the first and second type abrader shafts have primary abrader bars spatially secured to the circumferences thereof, and secondary abrader bars spatially secured to the circumferences of the discs between the primary abrader bars.

8. A processor as claimed in claim 7 wherein restriction means are mounted on interior walls of the frame adjacent the shafts to prevent passage of wood fibre debris around the ends and sides of the first and second type abrader shafts.

9. A processor as claimed in claim 8 including a debris collecting chute below the first and second type abrader shafts.

10. A processor as claimed in claim 8 including a wood fibre debris inlet above the first and second type abrader shafts.

11. A processor as claimed in claim 10 wherein the first and second abrader shafts rotate in bearings secured to respective walls of the frame.

12. A processor as claimed in claim 8 wherein the first type abrader shaft has at least ten radially disposed discs spatially mounted thereon, and the second type abrader shaft has at least eleven radially disposed discs spatially mounted thereon, alternating in offset position with the discs on the first type abrader shaft, the primary abrader bars being arranged around the circumference of the discs at 90° positions relative to one another.

13. A processor as claimed in claim 12 including an adjustable debris discharge gate located away from the debris inlet.

14. A processor as claimed in claim 12 wherein the primary abrader bars are disposed 45° relative to the radius of the circular discs, and two secondary abrader bars are secured to the circumference of each of the discs for every single primary abrader bar.

15. A processor as claimed in claim 13 wherein the frame has a rock disposal gate built into the bottom region of the frame.

16. A processor as claimed in claim 7 wherein the discs have debris clearing means on the faces of the discs.

17. A processor as claimed in claim 7 wherein the abrader bars are removable.

18. A wood fibre debris processor compressing:

(a) an enclosed hollow frame having first and second sides;

(b) a first rotatable abrader shaft disposed laterally across an interior of and proximate to a first side of the frame, a plurality of first discs radially and spatially disposed along the length of the abrader shaft, each first disc having around the circumference thereof at least one wood fibre debris abrader bar;

(c) a second rotatable abrader shaft disposed laterally across an interior of the frame, parallel to and spaced from the first abrader shaft to the interior of the frame, and disposed at an elevation higher than the elevation of the first abrader shaft, a plurality of second discs radially and spatially disposed along the length of the second abrader shaft, and offset in position with the first discs, each second disc having around the circumference thereof at least one wood fibre debris abrader bar;

(d) a third rotatable abrader shaft disposed laterally across an interior of the frame, parallel to and spaced from the first and second abrader shafts to the interior of the frame, and disposed at an elevation higher than the elevations of the first and second abrader shafts, a plurality of third discs radially and spatially disposed along the length of the third abrader shaft, and offset in position with the second discs, each third disc having around the circumference thereof at least one wood fibre debris abrader bar; and (e) a fourth rotatable abrader shaft disposed laterally across an interior of the frame parallel to and spaced from the first, second and third abrader shafts, and proximate to a second side of the frame, and disposed at an elevation higher than the elevation of the first, second and third abrader shafts, a plurality of fourth discs radially and spatially disposed along the length of the fourth abrader shaft, and offset in position with the third discs, each fourth disc having around the circumference thereof at least one wood fibre debris abrader bar, the proximate circumferences of the radially and spatially disposed first, second, third and fourth discs on the first, second, third and fourth abrader shafts intersecting on common planes with adjacent discs to provide a network of openings between the radially and spatially disposed alternating discs and the abrader shafts.

* * * * *